United States Patent [19]

Addona, Sr.

[11] Patent Number: 4,742,592

[45] Date of Patent: May 10, 1988

[54] HYDROFOIL ATTACHMENT FOR POOL CLEANING TOOL

[76] Inventor: Thomas J. Addona, Sr., 505 Chestnut Hill Ave., Waterbury, Conn. 06704

[21] Appl. No.: 95,633

[22] Filed: Sep. 14, 1987

Related U.S. Application Data

[63] Continuation-in-part of Ser. No. 902,698, Dec. 5, 1986, abandoned.

[51] Int. Cl.[4] ..... E04H 3/20

[52] U.S. Cl. ..... 15/1.07; 15/160; 15/236 R; 15/257 R

[58] Field of Search ..... 15/1.7, 160, 236 R, 15/257 R

[56] References Cited

U.S. PATENT DOCUMENTS

| | | | |
|---|---|---|---|
| 2,243,576 | 5/1941 | Otto | 15/1.7 |
| 3,003,168 | 10/1961 | Shouldice | 15/1.7 |
| 3,402,413 | 9/1968 | Gibellina | 15/1.7 |
| 4,637,087 | 1/1987 | Feinberg | 15/1.7 |

*Primary Examiner*—Edward L. Roberts
*Attorney, Agent, or Firm*—Alvin S. Blum

[57] ABSTRACT

A hydrofoil attaches to a long-handled swimming pool brush pole at a fixed angle that forces the brush against the pool wall on a forward stroke. It pulls the brush away from the wall on a reverse stroke. Forces between hydrofoil and brush and pole are distributed by multiple pole clamps and contact of foil edge against the head of the brush.

14 Claims, 5 Drawing Sheets

3
28
27
24
28
27
8
9
26
23
4
2
17
26
10
15
16
1
14
13
12
11

HYDROFOIL ATTACHMENT FOR POOL CLEANING TOOL

This invention is a continuation in part of copending application Ser. No. 06/902,698 filed 12/05/86, now abandoned.

BACKGROUND OF THE INVENTION

This invention relates to swimming pool cleaning tools and, more particularly, to a hydrofoil attachment for long-handled tools that forces the tool against the pool surface for more effective scrubbing.

To properly maintain a swimming pool, the walls and bottom must be periodically scrubbed free of dirt, algae, and the like. This material is ordinarily brushed to a suction intake of the bottom where it is then pumped through a filter to remove the foreign matter from the water. The operator ordinarily stands beside the pool and reaches the surface to be scrubbed with a long-handled scrubbing brush. Because of the long lever arm, the operator can force the brush against the surface to be scrubbed with sufficient force to be effective only with great effort. It is common to use thin-wall aluminum tubes for these handles. These tend to bend under the scrubbing force, further complicating the process.

U.S. Pat. Nos. 2,243,576 and 3,003,168 teach hydrofoils with moving blades that force the brush against the wall on both push and pull scrubbing strokes. U.S. Pat. No. 4,637,087 provides a fixed foil with movable valves to eliminate hydrofoil action on the pull stroke. U.S. Pat. No. 3,402,413 teaches a curved scoop with side walls attached to a brush by a strap. None of the above references teach the unique structure, functions and advantages of the instant invention as herein disclosed.

SUMMARY OF THE INVENTION

The attachment comprises: a substantially planar foil or blade; at least two clamping connections for removably clamping the foil to the pole or pole-connecting portion of the brush, scraper or other underwater cleaning tool. The clamping connections connect the blade to the tool with a fixed angle of 25 to 45 degrees between the hydrofoil surface and the long axis of the pole. Multiple clamping connectors distribute the stresses more uniformly onto the blade. The blade has a leading edge arranged to contact the tool along an extended contact line to further distribute the stresses on the blade.

The fixed angle of the blade causes the brush to be urged forcefully against the pool wall when the pole is thrust forward, scraping dirt forward along the wall toward the pool bottom and thence to the outlet (suction). The blade pulls the brush away from the wall and from the accumulated scrubbed-off dirt. on the return stroke. This same process occurs when scrubbing the bottom of the pool. The result is that the scrubbed-off dirt accumulates in a gradually increasing pile as it is pushed toward the suction. By contrast, if the brush is not pulled away from the wall or bottom on the return stroke, turbulence stirs up and disperses the pile and dirt brushed loose and close to the wall is pulled back and away from the suction, reducing the efficiency of the scrubbing effort. The metal fasteners of the clamps might inadvertently damage the walls of a plastic film swimming pool. For this reason, the clamping members have smooth projections extending beyond the fasteners to prevent the fasteners from contact with the pool walls.

These and other objects, features and advantages of the invention will become more fully apparent when the detailed description of the preferred embodiment of the invention is read in conjunction with the accompanying drawings, wherein.

DETAILED DESCRIPTION OF THE PREFERRED EMBODIMENT

Figure 1:
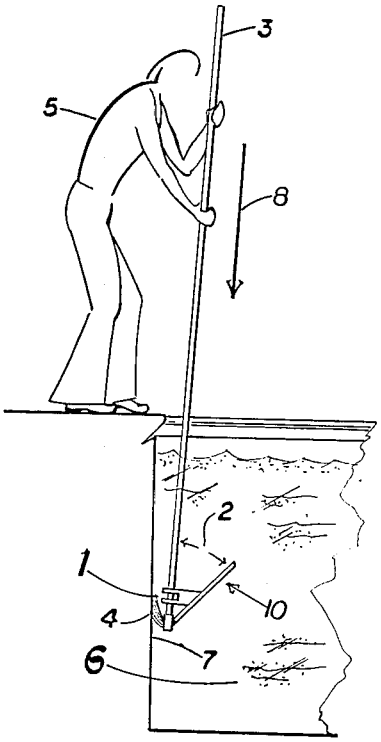
FIG. 1 illustrates diagrammatically the operation of the invention in forcing a brush against the pool wall during forward thrusting.
Figure 2:
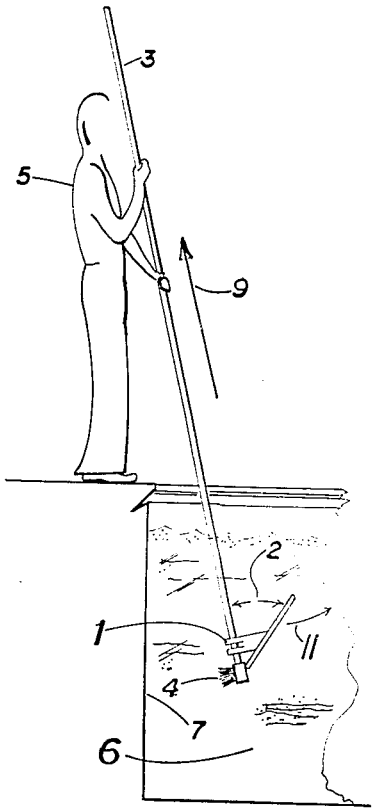
FIG. 2 illustrates diagrammatically the operation of the invention in forcing a brush away from the pool wall during retrieval.
Figure 3:
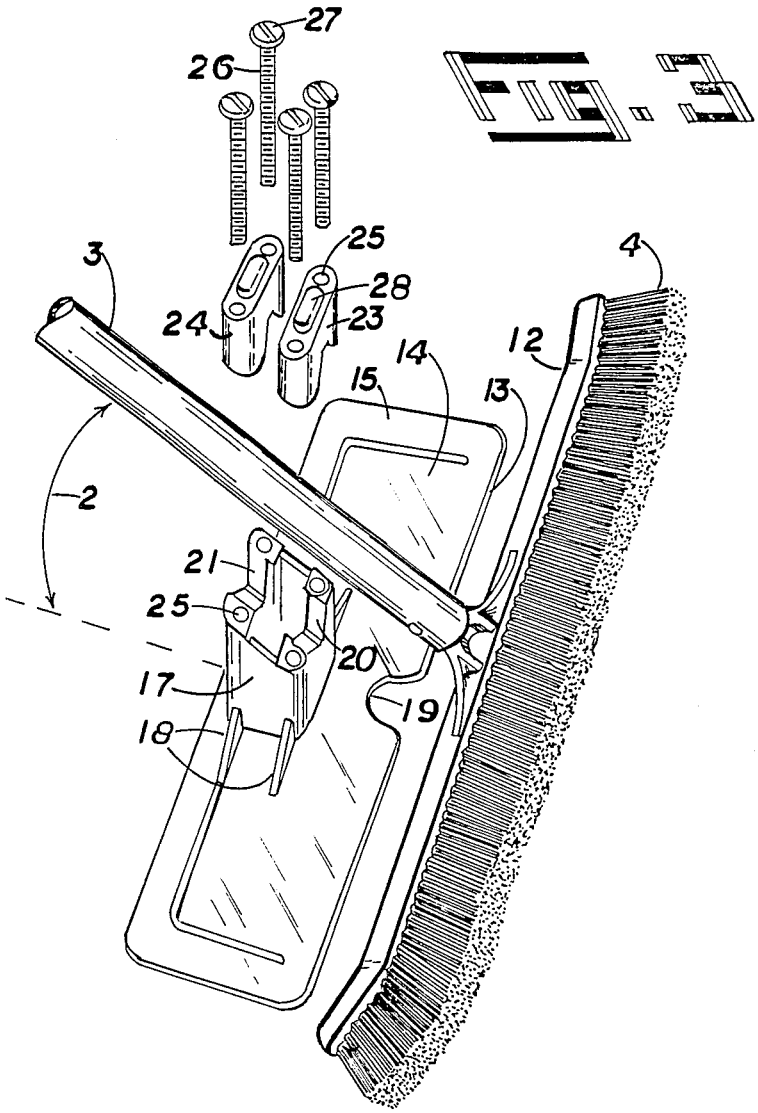
FIG. 3 is a perspective view of the invention ready to be clamped to a brush.
Figure 4:
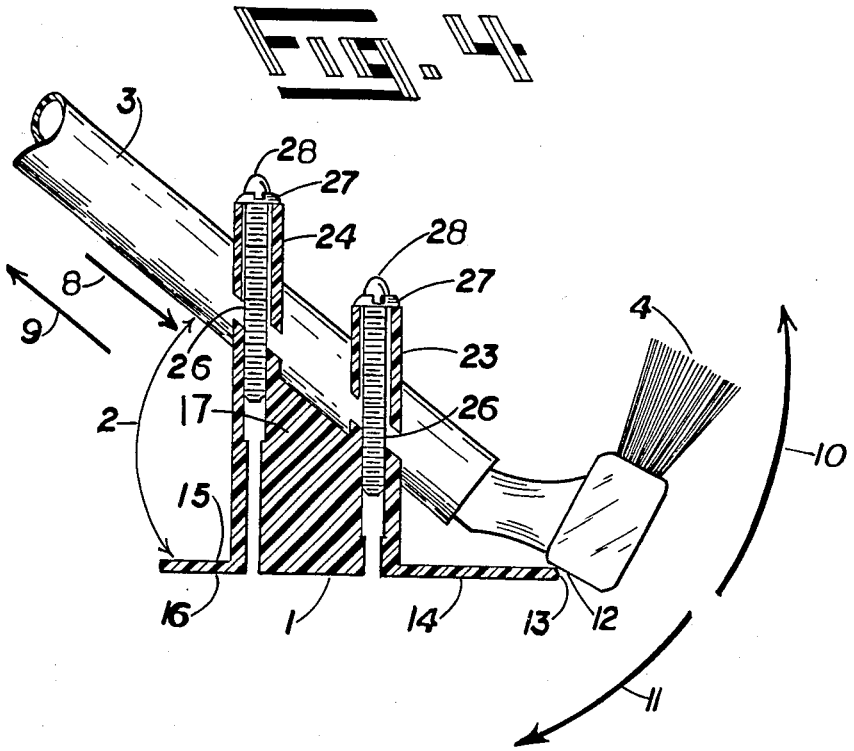
FIG. 4 is a cross-sectional view of the invention in place on a brush.
Figure 5:
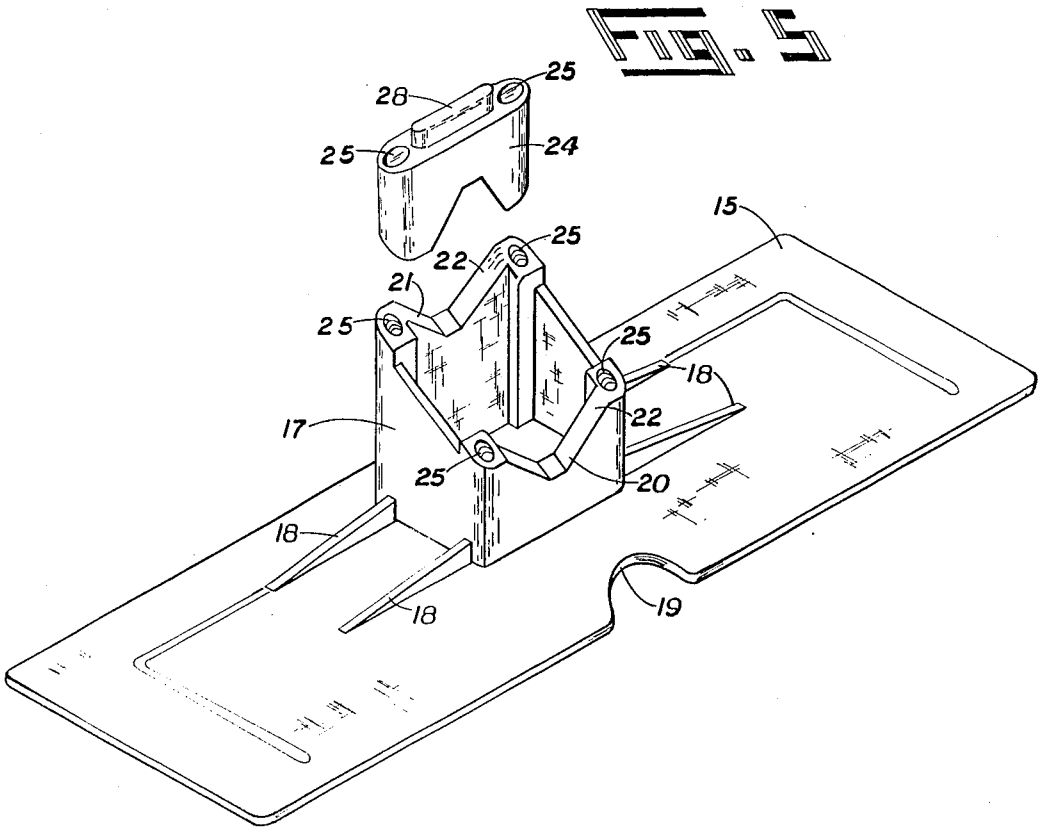
FIG. 5 is a perspective view of the invention.
Figure 6:
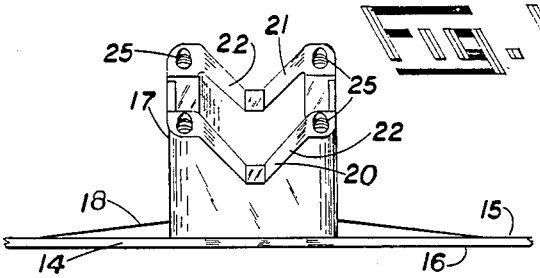
FIG. 6 is a front elevation view of the blade portion without the clamp members.
Figure 7:
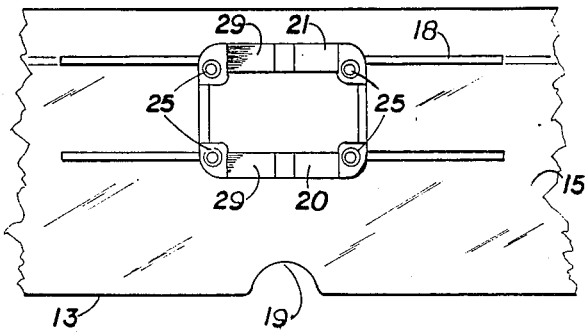
FIG. 7 is a top view of the blade portion without the clamp members.
Figure 8:
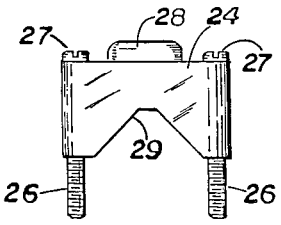
FIG. 8 is a front elevation view of a clamp member.
Figure 9:
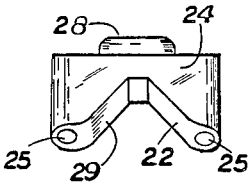
FIG. 9 is a rear elevation view of a clamp member.
Figure 10:
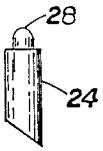
FIG. 10 is a side elevation view of a clamp member.

Referring now first to FIG. 1, we show that the device 1, on pole 3 at brush 4, forces the brush 4 in the direction of arrow 10 against the wall 7 of pool 6 when operator 5 forces the pole 3 downwardly, as indicated by directional arrow 8. This moves dirt downwardly. FIG. 2 shows that when operator 5 pulls pole upwardly, as indicated by directional arrow 9, the brush is pulled away from the wall, in the direction of arrow 11, thereby preventing the upwardly moving brush from disturbing the downward movement of the dirt alongside the wall. FIGS. 3 and 4 show how the device 1 is clamped onto the pole portion 3 of the brush 4 by means of the attaching base 17 having two V notches 20 and 21 and clamping members 23 and 24 with angled surfaces 22. The clamps present opposed V shapes to the cylindrical pole 3 to make the attachment fit poles of different diameters. The screws 26 fit into screw holes 25 The holes 25 in attaching base 17 may be threaded, they may alternatively be backed by a threaded nut, an insert thread or other threaded means well known in the fastener art. As shown in FIGS. 3–6, the reinforcing ribs 18 and the broad base of attaching base 17 form connections to the thin blade 14 that distribute the forces broadly upon the blade as it is forced against pole 3 by the force of water against blade surface 16 on forward thrust and away from pole 3 by hydrodynamic forces against blade surface 15 on retrieval. When clamped in place, the U shaped notch 19 in blade 1 permits the blade to fit around the pole 3 and blade forward edge 13 contacts top 12 of brush 4 along its length to further distribute forces from the blade to the brush. If the blade were clamped at only one point to the pole, there would be great torsional forces on the blade. The multiple points of contact and reinforcing ribs permit a thin plastic blade to withstand the considerable forces generated. Furthermore, because the brush is forced against the wall by forces at the distal end of pole 3, it need not be as rigid and resistant to bending as current poles. Therefore, a weight and cost saving may be realized in brush poles through the use of the invention. To prevent the head 27 of screws 26 (FIG. 3) from scratching the pool walls, the clamping members 24 and 25 (FIGS.

3,4,8–10) have a molded-in projection 28 that extends above the screw heads 27. The V shapes 29 in clamp members 23 and 24 combined with their angled pole contact surfaces can securely clamp to poles of different diameters without damage. These clamp members cooperate with similarly angled surfaces 22 of opposing V notches 20 and 21 in attaching base 17. Forces on the brush are thereby applied at two locations on the pole, as well as along the head 12 of brush 4. And the forces on blade 14 are applied throughout its connection with attaching base 17, the reinforcing ribs 18 and along the edge 13 that contacts the brush 4. In certain brush structures, a pole engaging sleeve portion of the brush may extend from the brush head 12. One or both clamping members 23 and 24 may engage the sleeve portion of the brush instead of the pole itself. The fixed angle 2 between blade 14 and pole 3 of thirty-five degrees has been found to be satisfactory in operation with certain brushes, although angles between twenty-five and forty-five degrees may be useful in certain applications. The hydrofoil 14 with reinforcing ribs 18 and attaching base 17 may be molded in one piece of light weight metal or a thermoplastic such as polyvinyl chloride, high impact styrene, nylon, polyolefin, acrylonitrile butadiene styrene, or polycarbonate. Alternatively, the tool may be a scraper for scraping heaving dirt or marine organisms off pool walls, seawalls, boats and the like.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An attachment for increasing the efficiency of a swimming pool cleaning tool which has a long pole means attached to said tool for cleaning a pool surface at a distance from the operator, comprising:

a. an angled hydrofoil for forcing said tool against said surface by hydrodynamic forces when said tool is moved away from said operator in a first, or scrubbing motion and for forcing said tool away from said surface in a second, or retrieval, motion;

b. pole clamping means for clamping said attachment to said pole means;

c. tool engaging means extending along an edge of said hydrofoil for applying the force generated by said first motion along an extended portion of said tool to apply said force uniformly to the cleaning action and to distribute the stresses more uniformly on said hydrofoil; and d. pole engaging means extending over an extensive area of said hydrofoil for applying the force generated by said first motion against said pole means to more uniformly apply said force and to distribute the stresses more uniformly on said hydrofoil.

2. The clamping means of claim 1, including fastening means and smooth extensions extending beyond said fastening means to protect said pool surface from damage caused by said fastening means.

3. The clamping means of claim 1 having opposed, substantially V shapes to provide effective clamping to pole means of different diameters.

4. The attachment according to claim 1 in which said clamping means includes means for clamping said hydrofoil to said pole means at a fixed angle of approximately thirty-five degrees.

5. The attachment according to claim 1 in which said clamping means includes means for clamping said hydrofoil to said pole means at a fixed angle of between twenty-five and forty-five degrees.

6. The attachment according to claim 5 in which said angle remains unchanged in said first and second motions.

7. The attacment according to claim 1 in which said tool is a brush.

8. The attachment according to claim 1 in which said tool is a scraper.

9. The attachment according to claim 1 in which said hydrofoil is substantially a thin flat plane with no sides.

10. The attachment according to claim 1 in which said clamping means includes at least two separate, spaced apart clamping elements.

11. The attachment according to claim 1 in which said pole engaging means includes reinforcing rib means connecting said hydrofoil to said pole engaging means for further distribution of forces.

12. The attachment according to claim 1 molded from thermoplastic material.

13. The attachment according to claim 12 in which said thermoplastic is selected from the group including; nylon, polyvinylchloride; acrylonitrile butadiene styrene; high impact styrene; polyolefin; and polycarbonate.

14. The attachment according to claim 1 is formed from light weight metal.

* * * * *